United States Patent [19]

Fujita

[11] 4,310,909

[45] Jan. 12, 1982

[54] ANALOG ELECTRONIC TIMEPIECE

[75] Inventor: Masanori Fujita, Tokyo, Japan

[73] Assignee: Kabushiki Kaisha Seikosha, Tokyo, Japan

[21] Appl. No.: 152,477

[22] Filed: May 22, 1980

[30] Foreign Application Priority Data

May 28, 1979 [JP] Japan ..... 54-71572[U]

[51] Int. Cl.[3] ..... G04C 17/02

[52] U.S. Cl. ..... 368/240

[58] Field of Search ..... 368/82-84, 368/239-242; 340/760, 765, 784; 350/331 T, 334, 336

[56] References Cited

U.S. PATENT DOCUMENTS 3,258,906 7/1966 Demby ..... 368/240
3,626,410 12/1971 deKoster ..... 368/240 X
3,908,355 9/1975 Wiesner ..... 368/240 X
4,007,583 2/1977 Johnson ..... 368/241 X
4,077,032 2/1978 Volkman ..... 368/239 X
4,198,810 4/1980 Fahrenschon ..... 368/239

*Primary Examiner*—Vit W. Miska
*Attorney, Agent, or Firm*—Robert E. Burns; Emmanuel J. Lobato; Bruce L. Adams

[57] ABSTRACT

In an analog electronic timepiece where a plurality of optical displaying elements in the form of pointers are disposed radially and the pointers are displayed optically in response to a clocking output, the short pointer is displayed separately by lighting up either one of the short pointer displaying segments adjacent to the lighted long pointer displaying segment in order to prevent the long pointer from being displayed alone when the displaying segments for the long and short pointers to be lighted up coincide thereby enabling the long and short pointers to be easily distinguished.

7 Claims, 6 Drawing Figures

ANALOG ELECTRONIC TIMEPIECE

BACKGROUND OF THE INVENTION

The present invention relates generally to an analog electronic timepiece in which optical pointers indicate the time with the aid of liquid crystal or the like, and more particularly to an analog electronic clock which can display a short pointer separately even when both short and long pointers are superimposed.

In a clock where the time is indicated analogously with the aid of liquid crystal, for instance, a part of the displaying segment for the long pointer is used also as the displaying segment for the short pointer and then the long and short pointers are displayed in the same width. Thus, when the displayed segments for the long and short pointers are superimposed once an hour, by way of example at the time 1:05 as shown in FIG. 6, the short pointer does not appear on the clock and the long pointer is displayed alone. In such a case a glance at the clock often leads to the misunderstanding that it might be malfunctioning or have failed.

SUMMARY OF THE INVENTION

An object of the present invention is to provide a novel analog electronic timepiece in which a plurality of optical displaying elements having the form to display both long and short pointers are disposed radially, the time is indicated through the display of the long and short pointers in response to clocking output, and either of the short pointer displaying segments adjacent to the segment that otherwise should be displayed lights up when the long and short pointers to be displayed are superimposed, thereby enabling to be indicated the time in a natural manner with ease to see.

DESCRIPTION OF THE PREFERRED EMBODIMENT

Figure 1:
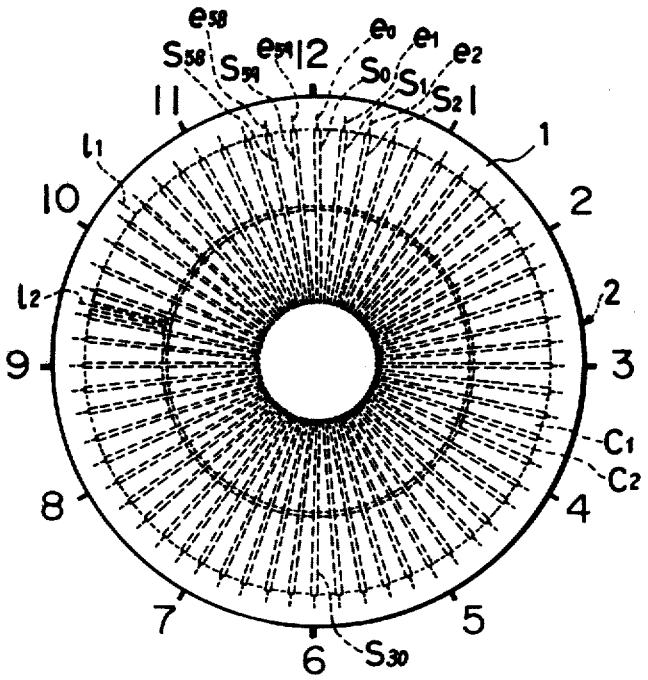
FIG. 1 is a plan view showing an embodiment of a display device used in the present invention.

In the following a preferred embodiment of the present invention is described with reference to the drawings. FIG. 1 shows a liquid crystal display device, in which two glass plates 1 and 2 are disposed oppositely and liquid crystal is interposed therebetween. 60 pieces of segment electrodes $S_0$–$S_{59}$ each of which is in the form of pointers are provided radially on the glass plate 1, and in opposition to the segment electrodes are provided common electrodes $C_1$ and $C_2$ ring form at outer and inner sides on the other glass plate 2, respectively. A liquid crystal displaying element for a short pointer consists of each segment electrode, the common electrode $C_2$ and the liquid crystal located therebetween, while a liquid crystal displaying element for a long pointer consists of each segment electrode, the common electrodes $C_1$, $C_2$ and the liquid crystal located therebetween. The common electrodes $C_1$, $C_2$ and the segment electrodes $S_0$–$S_{59}$ have lead wires $l_1$, $l_2$ and $e_0$–$e_{59}$ respectively and signal voltage as described hereinafter is supplied to each terminal of the lead wires.

Figure 2:
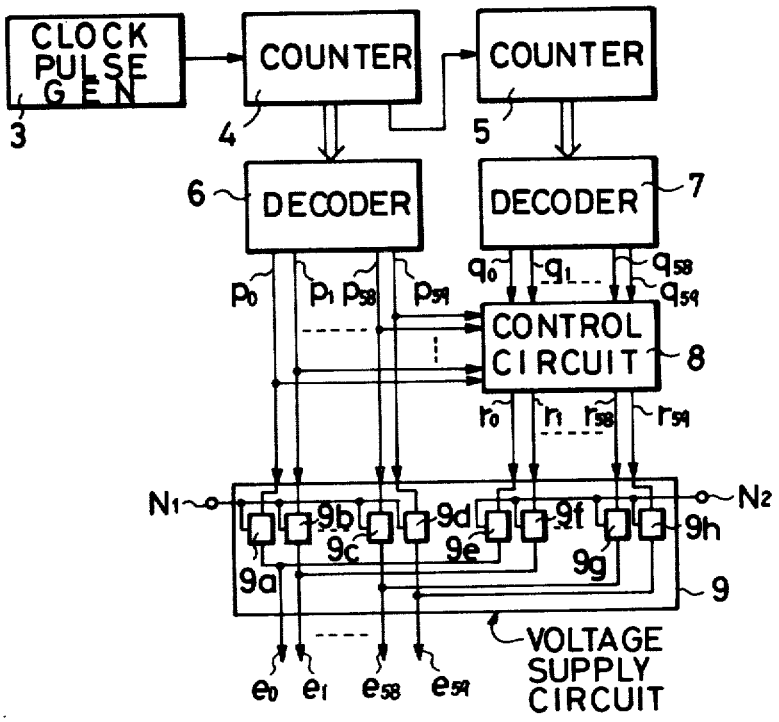
FIG. 2 is a block diagram of an electric circuit for operating the display device.

FIG. 2 shows a circuit diagram for clocking electronically and then lighting up the liquid crystal display device illustrated in FIG. 1 in response to a clocking output. A clock pulse generator 3 produces a series of pulses at the interval of 1 minute and the clocking for minute order is made at a counter 4. A counter 5 receives the clocking output at the interval of 12 minutes from the counter 4 and carries out the clocking for hour order. A decoder 6 receives the output from the counter 4 and generates a pulse at each terminal of $p_0$, $p_1$, . . . , $p_{58}$ and $p_{59}$ in turn for each 1 minute, while a decoder 7 generates a pulse at each terminal of $q_0$, $q_1$, . . . , $q_{58}$ and $q_{59}$ in turn for each 12 minutes. A control circuit 8 receives the outputs from the decoders 6 and 7 and generates an output to light up the short pointer displaying element with shift in its position when the displaying elements for the long and short pointers to be lighted up are superimposed. A voltage supply circuit 9 for the liquid crystal display device consists of analog switches, for example, and analog switches *9a*–*9h* are provided to connect with terminals $p_0$–$p_{59}$ and $r_0$–$r_{59}$ respectively. Each analog switch turns on when a selective output is applied to the corresponding terminal and either of the voltages applied on terminals $N_1$ and $N_2$ is then produced at one of terminals $e_0$–$e_{59}$. When the selective output is not applied to any terminal, the analog switches *9a*–*9h* are kept off.

Figure 3:
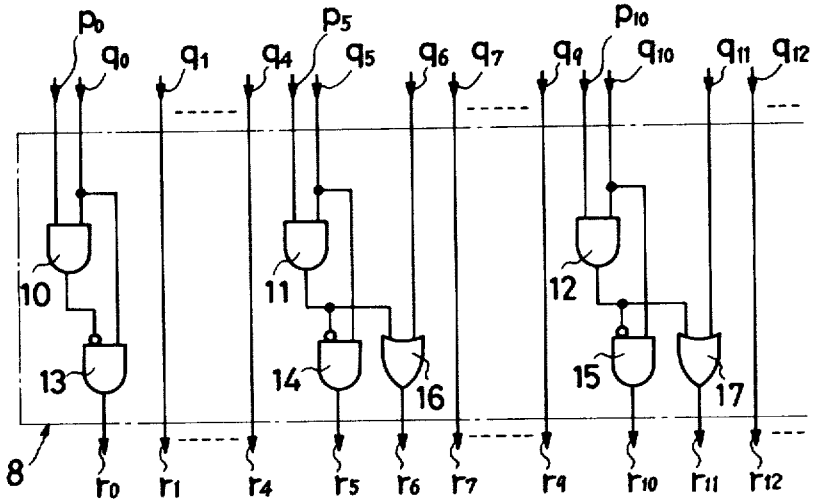
FIG. 3 is a logic circuit diagram showing the principal part of FIG. 2 in more detail.

FIG. 3 shows the control circuit 8 illustrated in FIG. 2 in more detail, in which the reference numbers 10–12 designate AND gate circuits, 13–15 designate inhibit gate circuits and 16–17 designate OR gate circuits.

The operation will be described hereinafter. To simplify the followed description, it is assumed here that the liquid crystal display device lights up at the voltage over Vo, voltages 0 and Vo are applied on the terminals $l_1$ and $l_2$ of the common electrodes $C_1$ and $C_2$, and voltages 2 Vo and Vo are applied on the terminals $N_1$ and $N_2$, respectively.

Now, since the selective output is produced at one of the terminals $p_0$–$p_{59}$ of the decoder 6 every 1 minute clocking by the counter 4 in turn, the analog switches *9a*, *9b* . . . *9c* and *9d* in the voltage supply circuit 9 turn on correspondingly in due order and the applied voltage 2 Vo on the terminal $N_1$ is given to each terminal of the segment e1 electrodes $S_0$–$S_{59}$ shown in FIG. 1 by turns. This lights up the selected displaying element by applying the voltages Vo, 2 Vo across its segment electrodes and common electrodes $C_1$, $C_2$, respectively. In such a manner, the long pointer or the minute pointer is advanced step by step at intervals of 1 minute.

When the short and long pointers are not superimposed, the short pointer is displayed as follows: the counter 5 changes its output every 12 minutes and then the selective output is produced at each terminal $q_0$–$q_{59}$ of the decoder 7 by turns. However, the displayed position of the short pointer is superimposed with that of the long pointer 12 times for its every turn at each of the following times: 12:00, 1:05, 2:10, 3:16 4:21, 5:27,6:32, 7:38, 8:43, 9:49, 10:54 and 11:59. The circuit diagram of FIG. 3 is arranged so as to display the short pointer adjacent to one otherwise to be displayed without lighting up the displaying element for the latter. At the time except for the above, since the levels at the terminals $p_0$ and $q_0$, $p_5$ and $q_5$, $p_{10}$ and $q_{10}$ . . . of the decoders 6 and 7 never show logic "1" simultaneously, the inhibit gate circuits 13,14,15 . . . are opened and then the selective outputs given at the terminals $q_0$, $q_5$, $q_{10}$ . . . pass through them. Thus, when both pointers are not superimposed, each selective output comes out at the corresponding terminal and the analog switches 9e,9f, . . . 9h turn on in due order, thereby introducing the voltage Vo applied on the terminal $N_2$ to the terminal of the segment electrode. Then, the voltage 0 is applied across the outer common electrodes $C_1$ and the opposing segment electrode, and the voltage Vo is applied across the inner electrode $C_2$ and the opposing electrode. As a result, the displaying element opposing to the inner electrode $C_2$ or the same for the short pointer is lighted up alone.

In the following, the operation will be described when the positions of both pointers to be displayed are superimposed, taking 1:15 as an example. At the time of 1:05, the selective outputs are produced from the terminal $p_5$, $q_5$ of the decoders 6 and 7.

Figure 4:
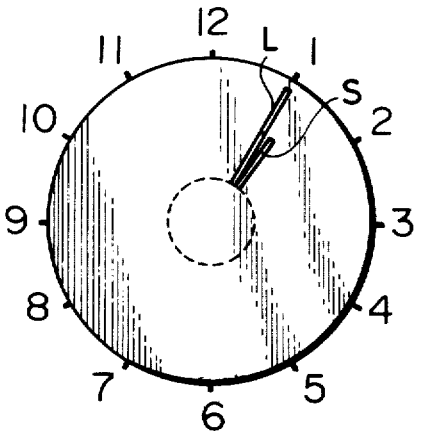
FIGS. 4 and 5 are front views showing embodiments for indicating the time according to the present invention.

Accordingly, the output from the inhibit circuit 14 shown in FIG. 3 is blocked and an output is produced at a terminal $r_6$ of the OR gate circuit 16 simultaneously. The output from the terminal $r_6$ produces the voltage for displaying the short pointer at the terminal $e_6$ of the voltage supply circuit 9, while the output from the terminal $p_5$ produces the voltage for displaying the long pointer at the terminal $e_3$ of the voltage supply circuit 9. As a result, the time 1:05 is indicated with the shift of the displayed position of the short pointers S from that of the long pointers L in a natural manner, as shown in FIG. 4.

Figure 5:
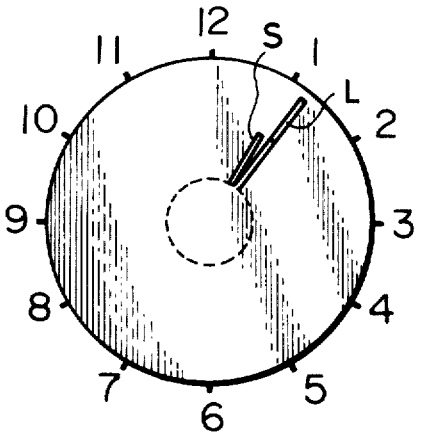
Figure 6:
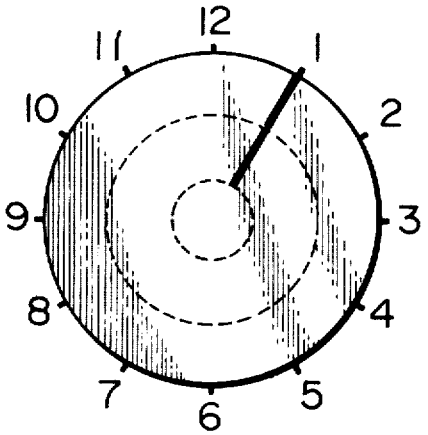
FIG. 6 PRIOR ART
FIG. 6 is a front view showing the manner of indicating the time in the prior art when the displaying segments for the long and short pointers to be lighted up are superimposed.

At the time 1:06, outputs are produced from the terminals $p_6$ and $q_5$ and this makes the output logic from the AND gate 11 in FIG. 3 into "0" and then the output is produced from the terminal $r_5$ of the inhibit gate circuit 14, while stopping the output from the OR gate circuit 16. Therefore, the time 1:06 is indicated normally as shown in FIG. 5.

Similarly, at each time as indicated above in which the positions of both pointers to be displayed are superimposed, the time is indicated with the short pointer advancing by one step temporarily.

However, at the time 12:00, only the long pointer is displayed due to the fact that the shift in displayed position of the short pointers would look rather strange. More specifically, the outputs produced from the terminals $p_0$ and $q_0$ at the time 12:00 make the output logic from the AND gate circuit 10 in FIG. 3 into "1" and then the output from the inhibit gate circuit 13 is blocked, while effecting the display of the long pointer through the output from the terminal $p_o$ alone.

At any time except for the aforementioned each time when the displayed position of the pointers are superimposed, the outputs appeared which appear on the respective terminals $q_0$ . . . $q_{59}$ of the decoder 7 are directly produced at the respective terminals $r_0$ . . . $r_{59}$ of the control circuit 8, so that the display of the short pointer is effected.

Though the aforementioned explanation has been made with respect to the embodiment in which the display of the short pointer is effected by turning on the position immediately after the superimposed displayed position, in the case that the displayed positions are superimposed at a time during from 7:38 till 11:59, it may be also possible to turn on the position immediately before the superimposed displayed position.

In this case, a part of the circuit shown in FIG. 3 should be modified. This is achieved by connecting each OR gate circuit to the terminal just prior to one at which both pointers are superimposed.

Taking the gate circuits 11, 14 and 16 as an example, although the terminal inputs are not same, the above modification can be made by removing the OR gate circuit 16, connecting the terminals $q_6$ to the terminal $r_6$ directly and providing an OR gate circuit so that it receives the outputs from the AND gate circuit 11 and the terminal $q_4$ and produces its output at the terminal 4. This explanation is made referring to the terminal numbers different from the practice, but the modified circuit can be similarly arranged from the terminals corresponding to the above each time after 7:38, too.

Furthermore, it is a matter of course that the form of electrode used in the display device, wiring system for leads and others are not restricted to the afore-mentioned embodiment.

As will be clear from what has been described heretofore, according to the present invention, the short pointer is displayed with a shift in its position temporarily when the long and short pointers to be displayed are superimposed, thereby enabling to indicate the time in a natural manner with ease to see.

What is claimed is:

1. An analog electronic timepiece comprising:

a plurality of first display segments which are radially arrayed;

a plurality of second display segments each of which is arrayed on an extension line of a corresponding one of said first display segments;

a drive circuit for driving said display segments which selectively turns on any one of the first display segments to indicate a short pointer display and selectively turns on any one of the first display segments and the second display segment on the extension line thereof to indicate a long pointer display; and a control circuit coupled to said drive circuit which, when one first display segment indicating the short pointer and one first display segment indicating a part of the long pointer display coincide, causes at least one of the first display segments adjacent to the first display segment which displays the long pointer display to display the short pointer display.

2. An analog electronic timepiece in which the time is indicated by short and long pointer displays, the timepiece comprising: a plurality of angularly spaced-apart first display segments; a plurality of angularly spaced-apart second display segments each of which is aligned with and extends radially outwardly of a respective first display segment; a drive circuit having means for sequentially rendering successive first display segments operative and inoperative to provide the short pointer display, and for sequentially rendering successive aligned first and second segments operative and inoperative to provide the long pointer display; and a control circuit coupled to said drive circuit and having means operative on at least one occasion when there is coincidence between one first display segment which provides both the short pointer display and a part of the long pointer display for rendering operative a first display segment immediately adjacent to the said one first display segment to thereby enable the short and long pointer displays to be easily distinguished.

3. A timepiece as claimed in claim 2; in which each of the displays is a liquid crystal display.

4. A timepiece as claimed in claim 3; in which the timepiece has a liquid crystal display device comprising two glass plates with liquid crystal material therebetween, one of the plates being provided with sixty angularly spaced-apart radially extending segment electrodes, and the other plate being provided with two radially spaced-apart annular electrodes.

5. A timepiece as claimed in any one of claims 2, 3 and 4; in which on said at least one occasion the control circuit includes means for temporarily advancing the said one first display segment by one step.

6. A timepiece as claimed in any one of claims 2, 3 and 4; in which the control circuit renders operative a first display segment immediately adjacent to the said one first display segment on every occasion when the said coincidence exists except at the time 12:00 when the said coincidence is allowed to occur.

7. A timepiece as claimed in any one of claims 2, 3 and 4; in which the short and long pointer displays respectively represent hours and minutes.

* * * * *